United States Patent [19]

Mobley et al.

[11] Patent Number: 4,713,860

[45] Date of Patent: Dec. 22, 1987

[54] HANDLE ASSEMBLY

[75] Inventors: Lawrence R. Mobley, Parker; Mark B. Nordstrom, Denver; Roger D. Winter, Lakewood, all of Colo.

[73] Assignee: Samsonite Corporation, Denver, Colo.

[21] Appl. No.: 341,745

[22] Filed: Jan. 22, 1982

[51] Int. Cl.[4] ..... A45C 13/00

[52] U.S. Cl. ..... 16/111 R; 16/112; 16/114 R

[58] Field of Search ..... 16/111 R, 114 R, 112, 16/123, 126, 110 R, 119, 116 R, DIG. 24, DIG. 25, DIG. 40, DIG. 42, DIG. 12, DIG. 18, DIG. 19; 190/15

[56] References Cited

U.S. PATENT DOCUMENTS 2,652,908 9/1953 Fuller ..... 16/112 X

*Primary Examiner*—P. W. Echols
*Assistant Examiner*—Joseph M. Gorski
*Attorney, Agent, or Firm*—Sheridan, Ross & McIntosh

[57] ABSTRACT

A handle assembly including a gripping handle, a pair of posts adapted for connection to a piece of luggage, and a cover unit is provided. Each of the posts includes a hole. Each of the posts is insertable into one of two slots formed in the gripping handle. The gripping handle includes openings. A locking pin is inserted into the openings and each post hole to connect the gripping handle to the posts. The cover unit is fixedly fitted over the locking pins so that the locking pins are substantially concealed from view.

12 Claims, 4 Drawing Figures

HANDLE ASSEMBLY

FIELD OF THE INVENTION

The present invention relates to luggage handle assemblies and, in particular, to a handle assembly characterizd by its simple construction, its ready attachment to luggage cases, and its aesthetically pleasing appearance.

BACKGROUND ART

Numerous and diverse handle assemblies for use with luggage cases or other articles have been previously devised. Each of such handle assemblies adequately meets its primary purpose of providing a mechanism for lifting and carrying the luggage case. However, a significant majority of such handle assemblies do not incorporate other worthwhile features in the same unit. Specifically, it is desirable to easily assemble together the elements of the handle assembly and also provide an efficient and relatively simple connection thereof to the luggage case or article itself. It is also desirable to provide an aesthetically pleasing handle assembly, which is also durable and maintains this appearance over extended use. Accordingly, an object of the present invention is to achieve these desired features of appropriate functionality, durability, ready assembly and manufacture, and pleasing appearance in a single handle assembly.

PRIOR ART STATEMENT

The following known prior art patent references are submitted under the provisions of 37 C.F.R. 1.97–1.99:

U.S. Pat. No. 2,652,908 to Fuller discloses a luggage handle having a pair of upright studs connected to a luggage piece. A metal strip overlies a grasping portion and the strip is received by slots in the studs and is connected thereat.

U.S. Pat. No. 3,692,155 to Laurita describes a handle assembly having ears adapted to be joined to luggage. Legs are joined to the ears and a cross member to be grasped is positioned between the legs. A rigid metal channel covers an outer edge region of the cross member.

U.S. Pat. No. 3,168,173 to Koffler relates to a collapsible handle which includes a gripping portion and a flexible metal strip having holes adjacent the ends thereof.

DISCLOSURE OF THE INVENTION

In accordance with the present invention, a handle assembly is provided for use with a luggage case or other article to lift and carry the luggage case or article. The handle assembly includes a pair of posts separated from each other and connected, for example, to the main body of a luggage case. Each post includes a hole. The handle assembly further includes a gripping handle having a pair of slots located at its ends. Each of the posts is placed into one of the slots. The gripping handle also has a groove or apertures formed therein. Locking pins are inserted through the groove or apertures and into the post holes to connect the gripping handle to the posts. A cover unit is fitted over the groove or apertures and is joined to the gripping handle to substantially hide the locking pins from view.

Based on this description, it is readily appreciated that a handle assembly is provided of simple construction yet highly functional and having a pleasing appearance. The structure of the gripping handle is such as to permit easy attachment to a luggage case or other article to be lifted or carried while avoiding the use of many cumbersome parts. The cover unit substantially conceals the locking pins from view thereby contributing to the appearance of a desirable integral design. In addition, the handle assembly is durable and designed for extended use.

Additional advantages of the present invention will become readily apparent from the following description taken in conjunction with the accompanying drawings.

DETAILED DESCRIPTION OF THE PREFERRED EMBODIMENTS OF THE INVENTION

Figure 1:
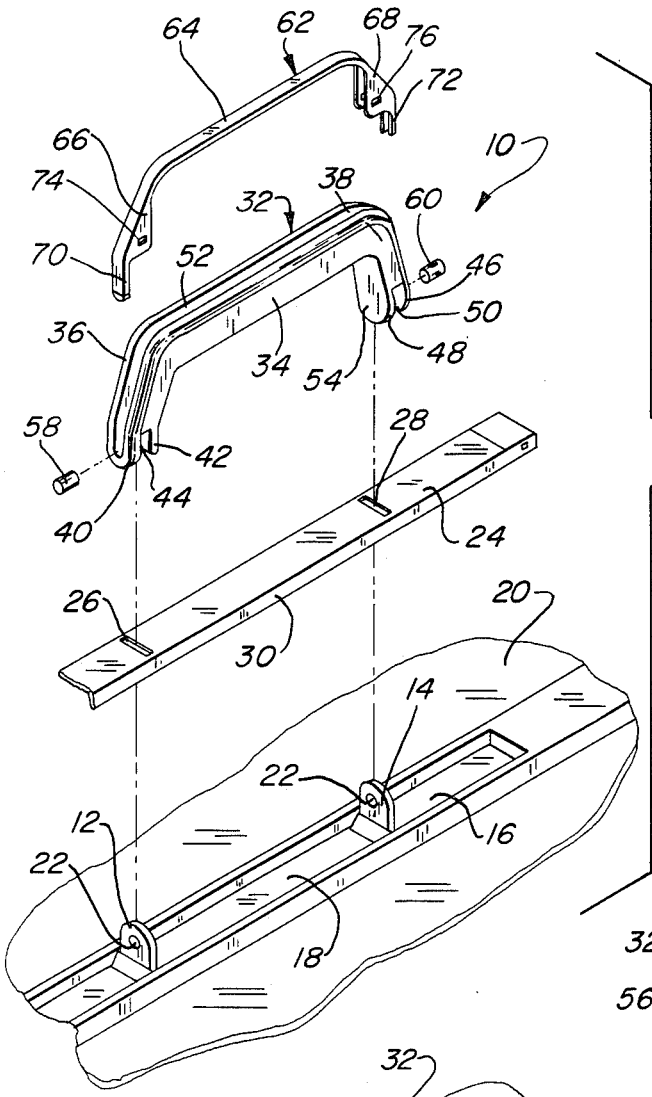
FIG. 1 is an exploded view of the handle assembly of the present invention.

In accordance with the present invention, a handle assembly 10 is depicted in FIG. 1 with the elements thereof separately shown. The handle assembly 10 includes a first post 12 and a second post 14 spaced therefrom. Each of the posts 12, 14 is positioned in a recess 16 formed in a base member 18. The posts 12, 14 and base member 18 are, preferably, integrally molded to provide a single, integral unit to simplify manufacture and assembly of parts of the handle assembly 10. The base member 18 is joined in a well-known manner to a standard luggage case 20 or other article. Each of the posts 12, 14 has a hole 22 formed through about the center position thereof.

The handle assembly 10 further includes a relatively narrow plate 24 having at least two slits 26, 28. The slits 26, 28 are spaced apart a distance corresponding to the distance between the first post 12 and the second post 14. The plate 24 also includes downwardly extending sides 30, one side being illustrated in FIG. 1. The sides 30 are adapted to be positioned in the recess 16 so that the upper surface of the plate 24 is flush or co-extensive with the upper surface of the base member 18.

The handle assembly 10 further includes a generally inverted U-shaped gripping handle 32. The gripping handle 32 includes a cross member 34 and two extending legs 36, 38 integrally joined to the cross member 34 at its ends. Leg 36 terminates in an outer finger 40 and an inner finger 42 spaced from the outer finger 40. A slot 44 is defined between the outer finger 40 and the inner finger 42. Similarly, leg 38 terminates in a outer finger 46 and an inner finger 48 spaced from the outer finger 46. A slot 50 is defined between the outer finger 46 and the inner finger 48. Each of the widths of the slots 44, 50 is substantially the same as each of the widths or lateral extends of the posts 12, 14.

A groove 52 is formed in the longitudinally extending upper surface of the gripping handle 32 and terminates at the ends of the outer fingers 40, 46. The groove 52 has a depth corresponding to the width of each of the outer fingers 40, 46. The gripping handle 32 also includes a solid lower surface 54 terminating at the ends of the inner fingers 42, 48. Integrally formed with each of the legs 36, 38 and extending therefrom are two bosses 56, as shown in FIG. 3, for purposes which will be discussed subsequently.

The handle assembly 10 also includes a coupling mechanism, specifically, a pair of locking pins 58, 60 and a cover unit 62. The cover unit 62 follows the structural contour of the gripping handle 32 and includes a narrow cross piece 64 having flanges 66, 68 integrally joined to its ends. End portions 70, 72 are integrally joined to the flanges 66, 68, respectively. The two flanges 66 each includes a window 74 and the two flanges 68 each includes a window 76.

In assembling the handle assembly 10 with the base member 18 securely attached to the luggage case 20 and the posts 12, 14 fixedly joined to the base member 18, the plate 24 is positioned in the recess 16 of the base member 18 after aligning the slits 26, 28 with the posts 12, 14, respectively. The slot 44 of the gripping handle 32 is next aligned to receive the first post 12 while the slot 50 is simultaneously aligned to receive the second post 14. After the gripping handle 32 is positioned with the posts 12, 14 inserted into the slots 44, 50, locking pin 58 is inserted through the groove 52 and into the hole 22 of the first post 12 and locking pin 60 is inserted through the groove 52 and into the hole 22 of the second post 14 to interconnect the gripping handle 32 and the posts 12, 14. Preferably also, each of the inner fingers 42, 48 includes a cavity (not shown) in axial alignment with the post holes 22 for receiving a locking pin end after it is inserted through the groove 52 and a post hole 22. The locking pins 58, 60 also permit rotational movement of the gripping handle 32 so that it can be placed flat with respect to the luggage case 20 when the gripping handle 32 is not being used.

Figure 3:
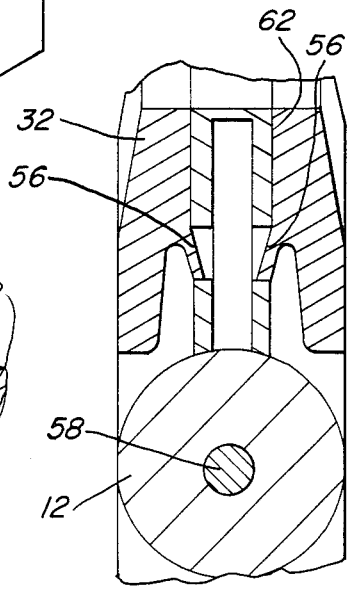
FIG. 3 is an enlarged, fragmentary longitudinal section showing the locking arrangement of the cover unit to the gripping handle.

Finally, the cover unit 62 is placed in the groove 52 and the windows 74, 76 are positioned to receive or engage the four bosses 56 of the gripping handle 32 in order to fixedly hold the cover unit 62 to the gripping handle 32, as best illustrated in FIG. 3.

Figure 2:
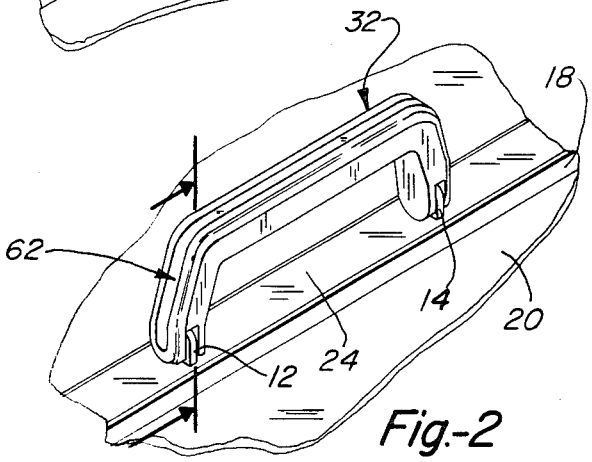
FIG. 2 is a perspective view of the handle assembly of the present invention in assembled form.

As can be seen in FIG. 2, fixedly positioning the cover unit 62 within the groove 52 conceals or hides the locking pins 58, 60 from view to enhance the appearance of the handle assembly 10 as an integral design. In addition, the end portions 70, 72 of the cover unit 62 terminate at the ends of the groove 52. Further contributing to the overall integral design appearance are the solid lower surface 54 of the gripping handle 32, which conceals opposite ends of the locking pins 58, 60, and also the substantial correspondence between the width of the slots 44, 50 and the width of the posts 12, 14.

Figure 4:
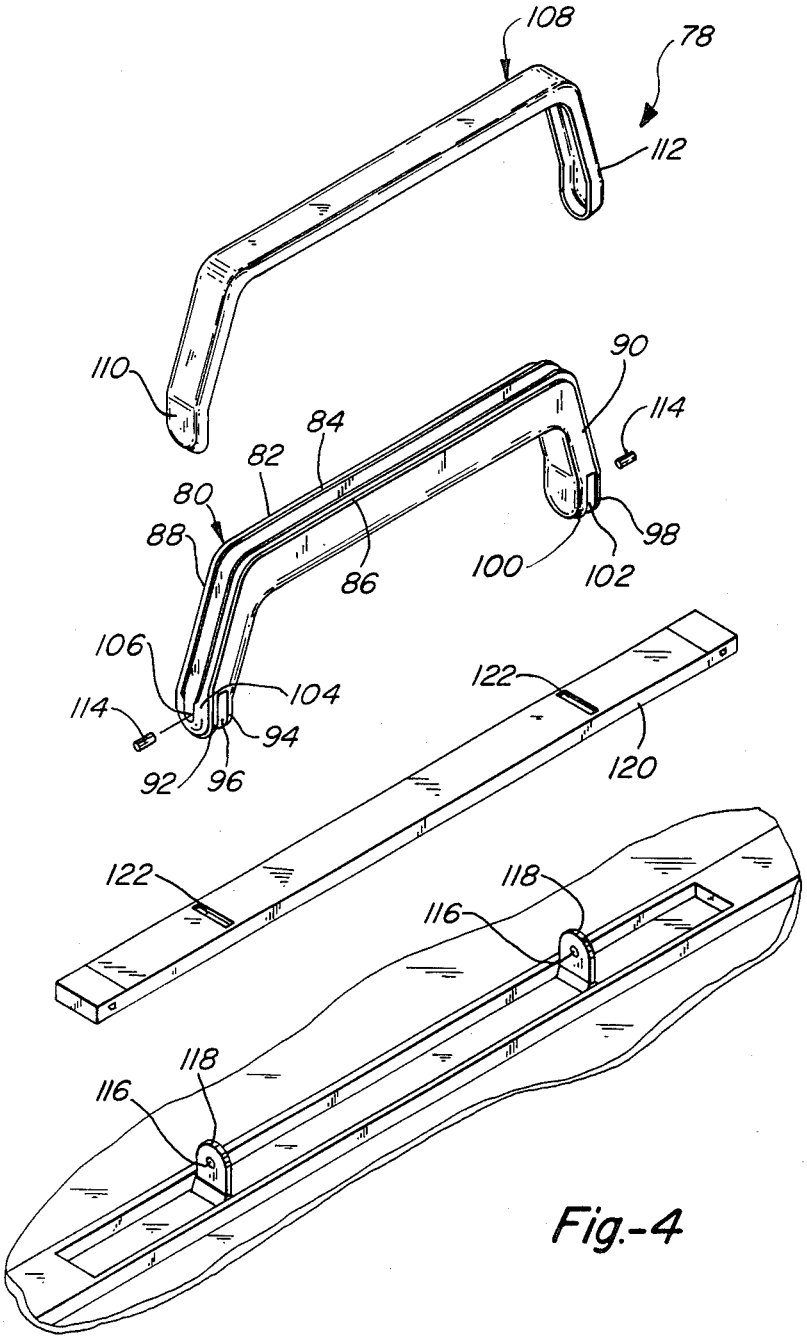
FIG. 4 is an exploded view of another embodiment of the present invention.

Another embodiment of the present invention is shown in FIG. 4. The primary difference between this embodiment and the embodiment of FIGS. 1–3 is the manner of connecting or coupling the cover unit to the gripping handle. More particularly, the handle assembly 78 of FIG. 4 includes a gripping handle 80 having a cross member 82, a pair of upstanding ribs 84, 86 and two extending legs 88, 90 integrally joined to the cross member 82 at its ends. The legs 88, 90 extend in a direction opposite that of the ribs 84, 86. Leg 88 terminates in an outer finger 92 and an inner finger 94 spaced from the outer finger 92. A slot 96 is defined between the outer finger 92 and the inner finger 94. Similarly, leg 90 terminates in an outer finger 98 and an inner finger 100 spaced from the outer finger 98. A slot 102 is defined between the outer finger 98 and the inner finger 100. Each of the outer fingers 92, 98 includes a protuberance or slightly extending portion 104. An aperture 106 is formed in each of the outer fingers 92, 98 at the protuberances 104. The handle assembly 78 further includes a cover unit 108 which follows the contour of the gripping handle 80. The cover unit 108 includes end portions 110, 112. In joining the cover unit 108 to the gripping handle 80, the cover unit 108 is positioned overlying the gripping handle ribs 84, 86. The end portions 110, 112 of the cover unit 108 fixedly receive the protuberances 104 in a secure mating manner to couple or retain together the cover unit 108 and the gripping hand 80. Like the embodiment of FIGS. 13, locking pins 114 are inserted into the apertures 106 of the outer fingers 92, 98 and holes 116 of posts 118, prior to joining the cover unit 108 and gripping handle 80 together. As also seen in FIG. 4, this embodiment also includes a plate 120 having slits 122 for receiving the posts 118 therethrough.

In view of the foregoing description, the present invention is seen to include a number of worthwhile features. The handle assembly is efficiently and quickly assembled for use with a luggage case or any other desired article. The handle assembly disclosed herein offers an integral-appearing design which is also completely functional for use in lifting and carrying articles. This handle assembly is designed to be extremely durable for long-lasting use while also presenting an aesthetically pleasing appearance. A further achievement of the present invention is the forming of posts and a base member as an integral unit by a molding process. As a result, the gripping handle can be readily fastened to a luggage article, which has the integral base member and posts joined thereto.

Although the present invention has been described with reference to only two particular embodiments, it is readily understood that variations and modifications can be effected within the spirit and scope of this invention.

What is claimed is:

1. A handle assembly comprising:

handle means including a gripping handle having an inner side, an outer side and ends;

at least one exposed opening in an outer side of said gripping handle adjacent each of said ends through which coupling means are inserted;

coupling means connecting said handle means to an article; and integral cover means joined to and substantially coextensive with said handle means and terminating adjacent said ends of said gripping handle and said cover means forming at least a portion of said outer side of said gripping handle and covering said openings and said coupling means so that said coupling means is substantially concealed from view.

2. An assembly, as claimed in claim 1, wherein said handle means includes:

a groove;

at least one post having a hole, said post adapted to be connected to the article, said coupling means inserted into said groove and said post pole, and said cover means located exteriorly of said post and said coupling means.

3. An assembly, as claimed in claim 1, wherein:

said cover means includes at least one window and said handle means includes at least one boss, said boss being inserted into said window for maintaining said cover means connected to said handle means.

4. A handle assembly as in claim 1 wherein:

said cover means terminates at a location between each of said exposed openings and each of said ends.

5. A handle assembly as in claim 4 and further comprising:

a protuberance projecting from said outer side of said gripping handle and being substantially coextensive therewith and terminating at a location between each of said openings and each of said ends;

said openings adjacent said ends extending through said protuberance; and at least a portion of said cover means covering said protuberance and said openings.

6. A handle assembly as in claim 4 and further comprising:

a groove formed in said outer side of said gripping handle and being substantially coextensive therewith;

said openings adjacent said ends extending through portions of said groove; and at least a portion of said cover means being located in said groove.

7. A handle assembly as in claim 6 and further comprising:

a base member connected to said article and having a pair of spaced posts secured thereto; and said coupling means being in operative association with said posts.

8. A handle assembly as in claim 7 wherein said coupling means includes:

a pair of spaced apart legs forming part of said gripping handle and terminating at said ends of said gripping handle;

each of said legs having a pair of fingers adjacent said ends;

each of said pair of fingers being spaced apart so as to form a slot therebetween;

said openings adjacent the ends of said legs being located in said outer fingers;

a recess in each of said inner fingers aligned with said openings;

openings in said posts aligned with said openings in said outer fingers and said recesses in said inner fingers when said posts are positioned in said slots; and pins having a smooth peripheral surface passing through said openings in said outer fingers, said openings in said posts and into said recesses in said inner fingers.

9. A handle assembly as in claim 7 and further comprising:

a recess formed in said base member with said posts being located in said recess;

a plate covering said recess; and a pair of slits in said plate through which said posts extend.

10. Apparatus for connecting a handle to an article comprising:

handle means and coupling means;

means secured to said article, having an opening extending therethrough and forming a first part of said coupling means;

means comprising at least one pin having a smooth peripheral surface and forming a second part of said coupling means;

means adjacent to the free ends of said handle to provide said handle with an opening in an outer portion thereof and a recess in an inner portion thereof and forming a third part of said coupling means;

said handle means connected to said first part of said coupling means by passing said pin through said opening in said outer portion of said handle means, through said opening in said first part of said coupling means and into said recess; and means for covering said opening to conceal the end of said pin and to prevent accidental removal of said pin.

11. Apparatus for connecting a handle to an article comprising:

handle means and coupling means for securing said handle to said article;

said handle means comprising a gripping portion and a pair of legs and each of said legs having a pair of fingers adjacent to a free end thereof;

each of said pair of fingers being spaced apart so as to form a slot therebetween, each of said pair of fingers including an outer finger and an inner finger;

an opening located in each of said outer fingers adjacent to said free end;

a recess in each of said inner fingers aligned with a respective one of said outer fingers and extending only partially into each of said inner fingers;

a pair of spaced apart posts secured to said article;

openings in said posts aligned with said openings in said outer fingers and said recesses in said inner fingers when said posts are positioned in said slots;

pins having a smooth peripheral surface passing through said openings in said outer fingers, said openings in said posts and into said recesses in said inner fingers; and means for covering said openings to conceal the end of said pins and to prevent accidental removal of said pins.

12. Apparatus as in claim 11 wherein said first part of said coupling means includes:

a base member secured to said article and having said spaced apart posts secured thereto;

a recess formed in said base member with said posts being located in said recess;

a plate covering said recess; and a pair of slits in said plate through which said posts extend.

* * * * *